US009153394B2

(12) United States Patent
Sibuet et al.

(10) Patent No.: US 9,153,394 B2
(45) Date of Patent: Oct. 6, 2015

(54) METHOD FOR FABRICATING A MICROSWITCH ACTUATABLE BY A MAGNETIC FIELD

(75) Inventors: Henri Sibuet, La Buisse (FR); Yannick Vuillermet, Chambery (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 428 days.

(21) Appl. No.: 13/340,785

(22) Filed: Dec. 30, 2011

(65) Prior Publication Data

US 2012/0168886 A1 Jul. 5, 2012

(30) Foreign Application Priority Data

Jan. 3, 2011 (FR) ..... 11 50027

(51) Int. Cl.

| | |
|---|---|
| ***H01H 11/00*** | (2006.01) |
| *H01H 1/66* | (2006.01) |
| *H01H 36/00* | (2006.01) |
| *H01H 1/00* | (2006.01) |

(52) U.S. Cl.

CPC ..... *H01H 11/005* (2013.01); *H01H 1/66* (2013.01); *H01H 36/0026* (2013.01); *H01H 2001/0078* (2013.01); *H01H 2036/0093* (2013.01)

(58) Field of Classification Search

None

See application file for complete search history.

(56) References Cited

U.S. PATENT DOCUMENTS

| | | | | |
|---|---|---|---|---|
| 5,149,673 | A * | 9/1992 | MacDonald et al. | 438/611 |
| 6,440,767 | B1 * | 8/2002 | Loo et al. | 438/52 |
| 2007/0046392 | A1 | 3/2007 | Hsu et al. | |
| 2009/0237188 | A1 | 9/2009 | Christenson | |

FOREIGN PATENT DOCUMENTS

| | | | |
|---|---|---|---|
| EP | 0874379 | | 10/1998 |
| EP | 1108677 | A1 | 6/2001 |
| JP | 2008243450 | A | 10/2008 |
| WO | WO 98/34269 | | 8/1998 |

OTHER PUBLICATIONS

Roth et al. "One Mask Nickel Micro-Fabricated Reed Relay", IEEE 176-180, 2000.

Hinohara et al. "Magnetic and Mechanical Design of Ultraminiature Reed Switches" IEEE Transactions on Components, Hybrids, and Manuacturing Technology, vol. 15, No. 2, 172-176, Apr. 1992.

* cited by examiner

*Primary Examiner* — Michael Jung

(74) *Attorney, Agent, or Firm* — Occhiuti & Rohlicek LLP

(57) ABSTRACT

The invention concerns a method for the fabrication, on a plane substrate, of a microswitch actuatable by a magnetic field, comprising:

a) the etching, in the upper face of the plane substrate, of cavities forming a hollow model of two strips, these cavities having vertical flanks extending perpendicularly to the plane of the substrate to form vertical faces of the strips, b) the filling of the cavities by a magnetic material to form the strips, then c) the etching in the substrate, by a method of isotropic etching, of a well that extends between the vertical faces of the strips and beneath and around one distal end of at least one of the strips to open out an air gap between these strips and make this distal end capable of being shifted between a closed position and an open position.

13 Claims, 2 Drawing Sheets

METHOD FOR FABRICATING A MICROSWITCH ACTUATABLE BY A MAGNETIC FIELD

BACKGROUND OF THE INVENTION

1. Field of the Invention

The invention pertains to a method for the fabrication, on a plane substrate, of a microswitch actuatable by a magnetic field. The invention also pertains to a microswitch of this kind.

Microswitches actuatable by a magnetic field are also called Reed switches.

Microswitches differ from macroscopic switches inter alia by their method of fabrication. The microswitches are made by using the same batch manufacturing methods as those used to make microelectronic chips. For example, the microswitches are made with a monocrystalline silicon or glass machined by photolithography and etching and/or structured by epitaxial growth and deposition of metallic material.

Prior art micro-switches comprise:

a plane substrate having an upper face, at least two strips of magnetic material having vertical faces that extend in parallel to the plane of the substrate and mutually define an air gap, at least one of the strips being capable of being shifted under the effect of the magnetic field, between:

a closed position in which the vertical faces of the two strips are directly in mechanical contact with each other to enable the passage of current, and an open position in which the vertical faces are separated from each other by the air gap to electrically insulate one strip from the other.

In these known microswitches, the shifting of the strips is done in parallel to the plane of the substrate. Thus, during the fabrication of these microswitches, the thickness of the strips parallel to the plane of the substrate can be defined very precisely by photolithography with almost no limitation. This enables the very fine and repeatable adjustment of certain important properties of the microswitch, such as for example, the rigidity of these strips. These advantages cannot be found in microswitches where the strips are shifted perpendicularly to the plane of the substrate.

2. Prior Art

Methods for fabricating these microswitches have already been proposed, for example in the patent application US 2009/0237188 or in the following article (article A1): S. Roth, C. Marxer, G. Feusier, N. F. De Rooij, "One mask nickel micro-fabricated reed relay", IEE 0-7803-5273-4, 2000.

However, the known methods are complex and call for a large number of etching steps. For example, the method of fabrication described in the article A1 requires an operation of etching a photosensitive resin to hollow out and release the vertical faces of the strips and another etching operation to eliminate a seeding layer situated between the strips.

Besides, in the prior-art microswitches, the strips project onto the upper face of the substrate. It is therefore necessary to add a hood to protect them. Now, this operation is complicated because it calls for high precision in the positioning of the hood relatively to the substrate.

In the prior art, the following are also known: JP2008243450A, US2007/046392A1, WO98/34269A1 and EP1108677A1.

SUMMARY OF THE INVENTION

The invention seeks to overcome at least one of these drawbacks by proposing a simpler method for fabricating a microswitch.

An object of the invention is therefore a method of fabrication comprising:

a) the etching, in the upper face of the plane substrate, of cavities forming a hollow model of two strips, these cavities having vertical flanks extending perpendicularly to the plane of the substrate to form vertical faces of the strips, then b) the filling of the cavities by a magnetic material to form the strips, then c) the etching in the substrate, by a method of isotropic etching, of a well that extends between the vertical faces of the strips and beneath and around one distal end of at least one of the strips to open out an air gap between these strips and make this distal end capable of being shifted between:

a closed position in which the vertical faces of the two strips are directly in mechanical contact with each other to enable the passage of a current, and an open position in which the vertical faces are separated from each other by the gap to electrically insulate one strip from the other.

The above method of fabrication is simpler because the isotropic etching makes it possible, in a single operation, to clear out material that is beneath and at the sides of the distal end of the shifting strip. In particular, it is therefore not necessary to deposit a sacrificial layer between the strips and the substrate and then remove this sacrificial layer to release the mobile strip.

The embodiments of this method of fabrication may comprise one or more of the following characteristics:

the etching steps are steps for etching a silicon substrate;

the method comprises, before the filling of the cavities, the deposition of a coating of conductive material on at least the vertical flanks, the thickness of this coating being strictly smaller than half of the thickness of the strips;

the filling of the cavities with a magnetic material is done by electrolytic deposition in using the coating of conductive material as an electrode;

after the filling of the cavities and before the etching of the well in the substrate, the method comprises the making of a hood, covering the space in which the well has to be etched, and the making of intake holes in this hood, and during the etching of the well, the intake through each intake hole of an isotropic etching agent to carry out the isotropic etching of the well beneath the hood and then, if necessary, the plugging of the holes;

the etching of the cavities on the upper face of the substrate is done by an anisotropic etching method;

the etching of the cavities also comprises the etching, at the same time, of cavities forming a hollow model of electrodes for the electrical connection of the strips to an external electrical circuit;

the filling of the cavities is done by depositing a layer of magnetic material on the entire upper face of the substrate, including outside the cavities, and then the method comprises the mechanical/chemical planarizing of this upper face to eliminate the deposit of magnetic material situated outside the cavities.

These embodiments of the fabrication method furthermore have the following advantages:

etching a silicon substrate makes it possible to obtain vertical faces that are almost perfectly parallel, thus reducing the resistance of the microswitch in the closed position;

coating the vertical faces of the strips with a coating of conductive material increases the conductivity of the microswitch in the closed position;

using the conductive coating as a conductive layer when performing electrolysis simplifies the fabrication method because this conductive coating does not have to be eliminated during a subsequent operation of the fabrication method;

making the hood directly on the top of the substrate containing the electrodes simplifies the fabrication method since it is no longer necessary to add on this hood and therefore have to position it precisely relatively to the well;

using anisotropic etching to hollow out the cavities gives perfectly vertical flanks, thus reducing the electrical resistance of the microswitch in the closed position;

etching cavities at the same time to make electrodes connected to these strips simplifies the fabrication method;

the mechanical/chemical planarization of the upper face of the substrate not only eliminates the deposits of magnetic material situated outside the cavities, but also restores a flat upper face thus facilitating the making of the hood during the subsequent steps.

An object of the invention is also a microswitch actuatable by a magnetic field, this microswitch comprising:

a plane substrate having an upper face, at least two strips of magnetic material having vertical faces that extend perpendicularly to the plane of the substrate and mutually define an air gap, at least one of the strips being capable of being shifted, under the effect of the magnetic field, between:

a closed position in which the vertical faces of the two strips are directly in mechanical contact with each other to enable the passage of current, and an open position in which the vertical faces are separated from each other by the air gap to electrically insulate one strip from the other, wherein the strips are entirely received within a well hollowed out in the substrate.

BRIEF DESCRIPTION OF THE DRAWINGS

The invention will be understood more clearly from the following description, given purely by way of a non-exhaustive example and made with reference to the drawings, of which.

In these figures, the same references are used to designate the same elements.

DETAILED DESCRIPTION OF THE INVENTION

Here below in this description, the characteristics and functions well known to those skilled in the art shall not be described in detail.

Figure 1:
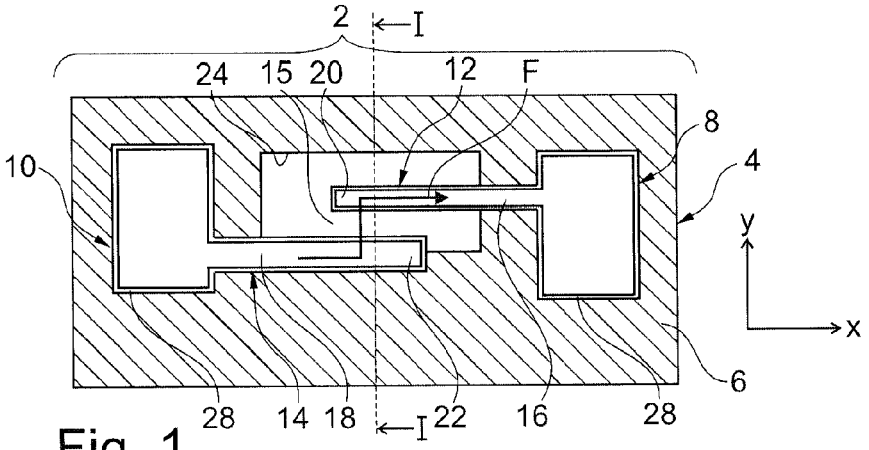
FIG. 1 is a schematic illustration in a top view of a microswitch.

FIG. 1 shows a microswitch 2 that can be actuated by an external magnetic field parallel to a direction X. This microswitch 2 is made in a plane substrate 4 that extends horizontally, i.e. in parallel to the orthogonal directions X and Y. Here below in this description, the vertical direction, orthogonal to the directions X and Y, is denoted as Z.

The substrate 4 is a rigid substrate. To this end, its thickness in the direction Z is greater than 200 μm and preferably greater than 500 μm. It is advantageously an electrically insulating substrate.

For example, here, this substrate 4 is a silicon substrate, i.e. a substrate comprising at least 10% and typically more than 50% by mass of silicon. This substrate is inorganic and non-photosensitive. The substrate 4 has a horizontal plane upper face 6.

The microswitch 2 has electrodes 8 and 10 through which there flows the current that passes through this microswitch. These electrodes 8 and 10 are fixed without any degree of freedom to the substrate 4. Here, these electrodes 8 and 10 are parallelograms whose upper faces are situated in the same plane as the upper face 6. The vertical faces of these electrodes extend into the substrate 4. The vertical faces of each electrode are connected to one another within the substrate by a lower face, for example parallel to the upper face.

Strips 12, 14 extend in parallel to the direction X starting from the electrodes, respectively 8 and 10. These strips 12, 14 can be shifted relatively to each other, under the effect of a magnetic field parallel to this direction X, between:

an open position (shown in FIG. 1) in which the strips are electrically insulated from each other by an air gap 15 filled with a dielectric gas, and a closed position in which the strips are directly mechanically in contact with each other to enable the passage of current between the electrodes 8 and 10.

Here, each strip has the shape of a parallelogram extending in parallel to the direction X. Thus, like the electrodes, each strip has:

an upper face situated on the same plane as the upper face 6 of the substrate 4, vertical faces which penetrate into the interior of the substrate 4, and a lower face situated beneath the face 6 of the substrate 4, and, for example, parallel to the upper face of this strip.

Each strip 12, 14 has a proximal end, respectively 16, 18 mechanically and electrically connected respectively to the electrodes 8 and 10. Here, the proximal ends 16 and 18 are connected without any degree of freedom to their respective electrodes. Thus, these proximal ends 16, 18 are immobile.

In this embodiment, the strips form one and the same block of material with the electrode to which they are mechanically connected.

Each strip 12, 14 also has a distal end respectively 20, 22. These distal ends 20 and 22 face each other and are separated from each other by the air gap 15 in the open position. Conversely, these distal ends are directly in contact on each other in the closed position.

Here, in this embodiment, only the distal end 20 is flexible so as to shift between the open and closed positions. The other distal end 22 is fixed without any degree of freedom to the substrate 4.

The distal end 20 moves solely in parallel to the horizontal plane X, Y. To this end, it is received within a well 24 filled with a dielectric gas such as air or the like. More specifically, the distal end 20 bends in order to reach the closed position from the open position. The deformations undergone by the distal end 20 between the closed and open positions are all elastic to enable it to return automatically to the open position when there is no external force.

To be flexible, the distal end 20 is far longer in the direction X than it is thick in the direction Y. For example, the distal end 20 is 5, 10 or 50 times longer than it is thick. Here, the thickness of the distal end 20 is smaller than 100 μm and preferably smaller than 50 or 10 μm.

The height of the distal end 20 in the direction 7 is typically, in this example, of the order of 20 to 50 μm.

The height of the fixed distal end 22 is equal here to the height of the mobile distal end 20.

The length and width of the fixed distal end 22 can have any unspecified value provided that there is sufficient magnetic material to concentrate the external magnetic field parallel to the direction X. Similarly, the dimensions of the strip 12 are big enough for it to remain capable of concentrating the external magnetic field parallel to the direction X.

The essential part of the strips 12, 14 and of the electrodes 8, 10 is made out of soft magnetic material. A soft magnetic material is a material having a relative permeability for which the real part at low frequency is greater than 1,000. Such a material typically has a coercive excitation in order to be demagnetized that is below 100 $A \cdot m^{-1}$. For example, the soft magnetic material used here is an alloy of iron and nickel.

To increase the electrical conductivity of the strips, the vertical and lower faces of these strips are covered with a conductive coating 28. This is also the case for the vertical and lower faces of the electrodes 8, 10. For example, this coating is made out of rhodium (Ro) or ruthenium (Ru) or platinum (Pt). The microswitch 2 also has a hood 30 (FIG. 2) that covers the well 24. To simplify FIG. 1, this hood is not shown therein.

Figure 2:
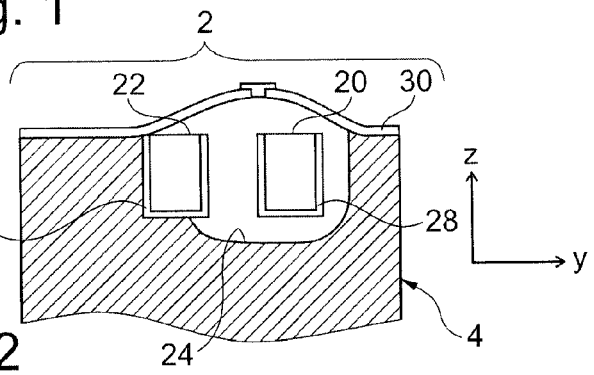
FIG. 2 is a schematic illustration in vertical section of a portion of the microswitch of FIG. 1.

FIG. 2 shows the microswitch 2 in a vertical section along a section plane I-I shown in FIG. 1. In this FIG. 2, the hood 30 which covers the well 24 is shown. This hood 30 prevents impurities from penetrating into the interior of the well 24 and hampering the shifting of the strip 12. It can be noted in this Figure that all the walls of the well and especially the bottom of the well are formed in the substrate 4 and by the substrate 4. The well 24 is a blind recess hollowed out into the substrate 4.

When an external magnetic field is applied in parallel to the direction X, it is concentrated and guided by the strips 12 and 14. The field lines of this magnetic field are symbolized by an arrow F in FIG. 1. This creates a force in the air gap 15 which tends to reduce this air gap. This force causes the distal end 20 to bend until it comes into contact with the distal end 22. Thus, an external magnetic field makes it possible to move the strip 12 between its open position and its closed position. When the external magnetic field disappears, the distal end 20 returns to the open position in the manner of a spring leaf by elastic deformation.

Figure 3:
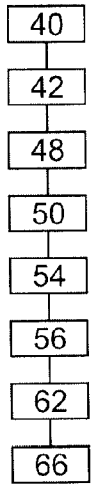
FIG. 3 is a flowchart of a method for fabricating a microswitch of FIG. 1.
Figure 4:
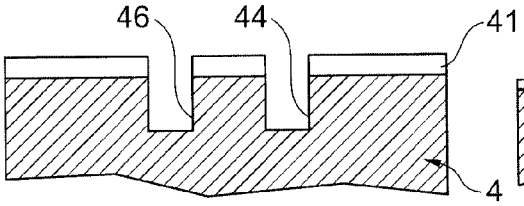
FIGS. 4 to 8 are schematic illustrations in vertical section of different steps in the fabrication of the microswitch when it is being fabricated by means of the method of FIG. 3.
Figure 7:
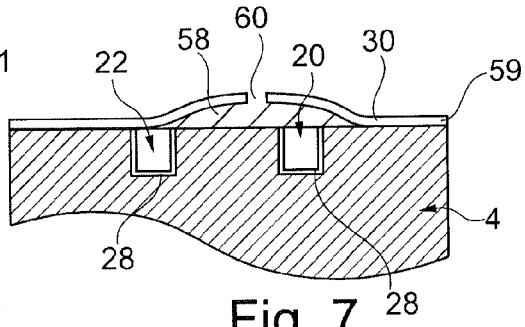

The fabrication of the microswitch 2 shall now be described in greater detail by means of the method shown in FIG. 3.

The fabrication method described is a collective or batch fabricating method using the technologies of fabrication methods of microelectronics. It therefore starts with the supply of a silicon wafer on which several microswitches will be fabricated simultaneously by means of the same operations. To simplify the following description, the different fabricating steps are described solely in the case of a single microswitch. Different states of fabrication obtained during the method of FIG. 3 are shown in vertical section in FIGS. 4 to 8.

At a step 40, a layer 41 (FIG. 4) of photosensitive resin is deposited on the upper face 6 of the substrate 4. Then, the zones in which cavities have to be hollowed out in the substrate 4 are defined by insolation of the resin. These zones correspond to the location of the electrodes and of the strips. Here, this is a classic step of photolithography.

At a step 42, an anisotropic etching of the defined zones is carried out to directly hollow out cavities 44, 46 (FIG. 4) in the substrate, forming a hollow model for the strips 12 and 14 and the electrodes 8 and 10. The term "anisotropic" etching herein designates an etching whose etching speed in the direction Z is at least ten times and preferably fifty or a hundred times greater than the etching speed in the horizontal directions X and Y. In other words, the horizontal etching speed is negligible relatively to the etching speed in the vertical direction. This gives flanks that are more vertical than if the etching were to be done by means of other etching methods. In particular, the flanks of the cavities 44, 46 thus hollowed out are more vertical than they would be if they had been hollowed out in a photosensitive resin using another etching method. For example, the method used here is a plasma etching or a deep silicon chemical etching.

At a step 48, the layer 41 of photosensitive resin is removed and the conductive coating 28 is deposited on the entire upper face. Thus, this conductive coating covers not only the vertical flanks of the cavities but also the bottom of the cavities as well as the upper face 6 of the substrate.

Figure 5:
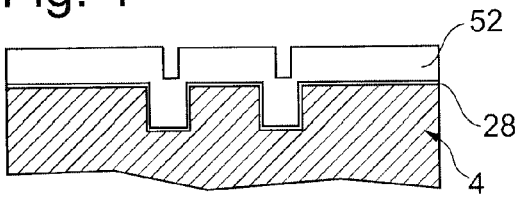

At a step 50, the cavities are filled with a soft magnetic material 52 (FIG. 5). Here, the filling is done by electrolytic deposition by using the coating 28 as a conductive electrode. Thus, this coating 28 also fulfills the function of a seed layer. Since the coating 28 extends over the entire face of the substrate 4, the material 52 is also deposited on the entire upper face of the substrate 4 as well as inside the cavities 44 and 46. Thus, the state shown in FIG. 5 is obtained.

Figure 6:
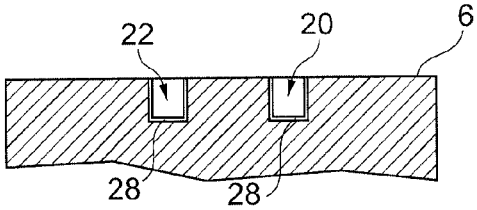

At a step 54, the mechanical/chemical planarization of the substrate 4 is performed to restore the plane upper face 6 of the substrate 4. Chemical mechanical planarization is also known by the acronym CMP. This planarization step is used herein to eliminate the material 52 and the coating 58 situated outside the cavities 44 and 46. At the end of this step, the state shown in FIG. 6 is obtained.

At a step 56, the hood 30 is deposited at the location in which the well 24 is to be hollowed out. To this end, an excess thickness 58 (FIG. 7) of material is deposited above the zone in which the well 24 has to be hollowed out. The material used to create this excess thickness 58 is capable of being etched by the same isotropic etching agent as the substrate 4. For example, here, the material is silicon. This excess thickness 58 space apart the hood 30 from the upper face of the distal ends 20 and 22. Then, again in this step 56, a thin layer 59 is deposited on the entire upper face of the substrate 4. This thin layer 59 is made out of a material resistant to the isotropic etching agent. Finally, in this thin layer 59 forming the hood 30, intake holes 60 are made for the isotropic etching agent. To simplify FIG. 7, only one of the holes 60 has been shown. These holes are laid out above the location at which the well 24 has to be hollowed out.

At a step 62, the substrate 4 is etched directly to make the well 24. During this step, the etching done is isotropic. An isotropic etching is a step of etching in which the etching speeds in the directions X, Y are equal to the etching speed in the direction Z plus or minus 50% and preferably plus or minus 20 or 10%.

At the step 62, the isotropic etching agent is put into direct contact with the silicon to be etched through the intake holes 60. The etching agent used is chosen so as not to react with the soft magnetic material 52 and the coating 28. For example, the etching agent is a gas $XeF_2$.

Figure 8:
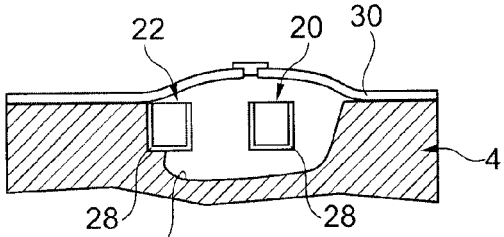

Since the etching agent is an isotropic etching agent, it releases the vertical faces of the ends 20 and 22 and at the same time the bottom, i.e. the lower face of the distal end 20 (FIG. 8).

Thus, at the end of this isotropic etching step, the well 24 is made.

Finally, at a step 66, the intake holes 60 are closed again if necessary and the wafer on which the different microchips had been made in a batch is cut out to separate the microswitches mechanically from one another.

Figure 9:
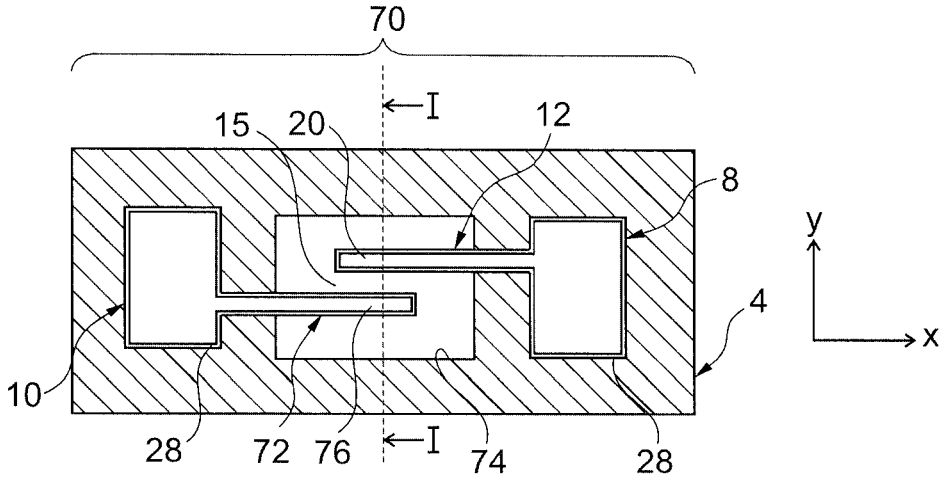
FIG. 9 is a schematic illustration in a top view of a second embodiment of a microswitch.

FIG. 9 shows a microswitch 70 identical to the microswitch 2 except that the strip 14 has been replaced by a flexible strip 72. For example, the strip 72 is identical to the strip 12 but is mechanically connected by its proximal end to the electrode 10. In order that the distal end of the strip 72 can move in response to the application of a magnetic field parallel to the direction X, the well 24 is replaced by a vaster well 74. More specifically, the well 74 surrounds the distal end 20 of the strip 12 as well as the distal end 26 of the strip 72 so as to enable a shifting of these two distal ends relatively to the substrate 4 between the open and closed positions.

The working of the microswitch 70 is also identical to that of the microswitch 2 except that, when an external magnetic field is applied along the direction X, the distal ends 20 and 76 both shift to come into contact with each other.

The method for fabricating the microswitch 70 is identical to the one described with reference to FIG. 3 except that the intake holes 60 are laid out so as to obtain the well 74 which surrounds the distal ends 20 and 76.

Figure 10:
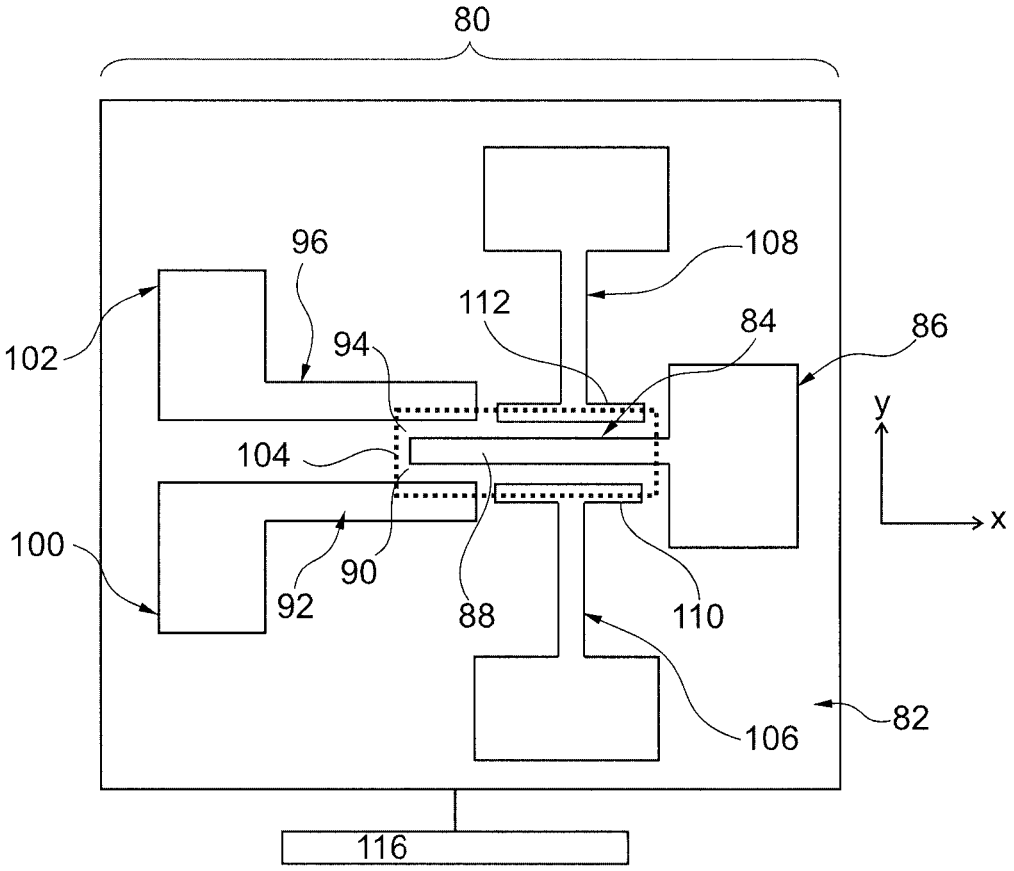
FIG. 10 is a schematic illustration in a top view of a third possible embodiment of a microswitch.

FIG. 10 shows a microswitch 80 made on a plane substrate 82. To simplify FIG. 10, the hood that covers this microswitch has not been represented. Typically, the microswitch 80 described here is a microswitch with one input and two outputs also known as an SPDT (single-pole, double-throw) microswitch.

This microswitch 80 has a flexible strip 84 whose proximal end is fixed without any degree of freedom to an electrode 86 which is itself fixed without any degree of freedom to the substrate 82. The strip 84 is made out of soft magnetic material. It has a distal end 88 that can be shifted between:

- an open position (shown in FIG. 10) in which it is electrically insulated from a fixed strip 92 by an air gap 90 and from a fixed strip 96 by an air gap 94,
- a first closed position PF1 in which it is directly mechanically in contact with the strip 92 to enable a circulation of current between the electrode 86 and the electrode 100, and
- a second closed position PF2 in which it is directly and mechanically in contact with the strip 96 to enable a circulation of current between the electrode 86 and the electrode 102.

To be able to shift, the distal end 88 is entirely received into a well 104 hollowed out in the substrate 82.

The strip 88 bends so as to move towards the closed position PF1 or PF2. However, these deformations are elastic to enable this strip to automatically return to its open position when there is no magnetic field.

The strips 92, 96 and the electrodes 100 and 102 are fixed without any degree of freedom to the substrate 82.

The microswitch 80 also has two electrostatic actuating electrodes 106 and 108. Each of these electrodes 106 and 108 has a plate, 110 and 112 respectively, facing the distal end 88. The plates 110 and 112 are each laid out on one respective side of the distal end 88. More specifically, the plate 110 is laid out to exert an electrostatic force on this distal end 88 capable of moving it to the closed position PF1. The plate 112 for its part is positioned so as to exert an electrostatic force on this same distal end 88 having an opposite sense so as to shift it up to the closed position PF2.

The microswitch 80 also has a magnetic field source 116 capable of keeping the end 88 in any one of its closed positions without the electrodes 106 and 108 being powered. To this end, the source 116 generates a permanent magnetic field parallel to the direction X. For example, this source 116 is a permanent magnet. The source 116 is incorporated or not incorporated into the substrate 82.

Thus, to make the distal end 88 pass from the closed position PF1 to the closed position PF2, a voltage is applied to the electrode 108. This voltage is sufficient for the electrostatic force exerted between the distal end 88 and the plate 112 to bring the distal end 88 towards the second closed position. Then, the supply to the electrode 108 is cut off and the distal end remains in its second closed position under the effect of the magnetic field generated by the source 116.

To make the distal end 88 pass from the closed position PF2 to the closed position PF1, the operations are the same except that the electrode 106 is supplied instead of the electrode 108.

The method for fabricating the microswitch 80 is similar to that described with reference to FIG. 3 except that, in addition to the cavities forming a hollow model of the electrodes and of the strips, additional cavities are made forming a hollow model of the electrodes 106 and 108. Then, the same steps as those described with reference to the method of FIG. 3 are applied to fill these cavities, eliminate the soft magnetic material and the coating situated outside these cavities and finally make the hood and the well 104.

As in the previous embodiments, all the electrodes and strips are situated inside the substrate, i.e. beneath the upper face of the substrate.

Many other embodiments are possible. For example the conductive coating 28 may be omitted. Another deposition technique could be used in this case, for example a physical vapor deposition (PVD) method. In another embodiment, this conductive coating is first of all deposited and then removed by etching.

The substrate 4 can be made out of other materials such as glass.

The microswitch can have several pairs of strips electrically connected to the same electrodes.

The fixed strip may have any unspecified shape. In particular, it is not necessary for it to be longer than it is thick, since it does not get deformed.

Other anisotropic or isotropic etching methods can be used.

As a variant, it is possible for the cavities to be only partially filled with magnetic material so that the upper face of the strips is situated beneath the upper face of the substrate.

Fabrication methods other than those described here are possible for the fabricating of a microswitch whose strips are entirely received within a well and therefore do not project beyond the upper face of the substrate.

The invention claimed is:

1. A method for fabricating, on a planar substrate, a microswitch actuatable by an external magnetic field, said method comprising etching, in an upper face of said planar substrate, cavities forming a hollow model of two strips, said cavities having vertical flanks extending perpendicularly to a plane of said planar substrate, filling said cavities with a magnetic material to form said two strips having vertical faces, said filling step including providing a conductive material on the vertical faces of said two strips, isotropically etching, in said planar substrate, a well that extends between said vertical faces of said two strips and beneath and around a distal end of at least one of said two strips to open an air gap between said two strips, whereby said distal end is made capable of being shifted between a closed position, in which said vertical faces of said two strips are in direct mechanical contact with each other to enable the passage of a current, and an open position, in which said vertical faces of said two strips are separated from each other by said air gap to electrically insulate one strip from the other, wherein the magnetic material is comprised of an alloy of iron and nickel.

2. The method of claim 1, wherein etching comprises etching a silicon substrate.

3. The method of claim 1, wherein providing the conductive material on at least the vertical faces of said two strips comprises, before filling said cavities with said magnetic material, causing deposition of a coating of said conductive material at least-on said vertical flanks, with a thickness being smaller than half of a thickness of said strips.

4. The method of claim 3, wherein filling said cavities with a magnetic material comprises electrolytic deposition using said coating of conductive material as an electrode.

5. The method of claim 1, wherein after filling said cavities and before etching said well in said planar substrate, making a hood that covers a space in which said well is etched, and making intake holes in said hood, and wherein during said etching of said well, causing intake, through said intake holes, of an isotropic etching agent to carry out isotropic etching beneath said hood.

6. The method of claim 5, further comprising plugging said intake holes.

7. The method of claim 1, wherein etching cavities on said upper face of said planar substrate comprises anisotropic etching.

8. The method of claim 1, further comprising etching, concurrently with etching said cavities, cavities forming a hollow model of electrodes for electrical connection of said strips to an external electrical circuit.

9. The method of claim 1, wherein filling said cavities comprises depositing a layer of magnetic material on an entire upper face of said planar substrate, including outside said cavities, and wherein said method further comprises planarizing said upper face to eliminate magnetic material deposited outside the cavities.

10. The method of claim 9, wherein planarizing said upper face comprises chemically planarizing said upper face.

11. The method of claim 9, wherein planarizing said upper face comprises mechanically planarizing said upper face.

12. A method for fabricating, on a planar substrate, a microswitch actuatable by an external magnetic field, said method comprising forming, in an upper face of said planar substrate, two strips having vertical faces extending perpendicularly to a plane of said planar substrate, said two strips having a conductive material on said vertical faces, isotropically etching, in said planar substrate, a well that extends between said vertical faces of said two strips and beneath and around a distal end of at least one of said two strips to open an air gap between said two strips, whereby said distal end is made capable of being shifted between a closed position, in which said vertical faces of said two strips are in direct mechanical contact with each other to enable the passage of a current, and an open position, in which said vertical faces of said two strips are separated from each other by said air gap to electrically insulate one strip from the other; wherein the step of forming said two strips comprises etching, in the upper face of said planar substrate, cavities forming a hollow model of said two strips, depositing a coating of said conductive material in said cavities and filling said cavities with a magnetic material to form said two strips.

13. A method for fabricating, on a planar substrate, a microswitch actuatable by an external magnetic field, said method comprising etching, in an upper face of said planar substrate, cavities forming a hollow model of two strips, said cavities having vertical flanks extending perpendicularly to a plane of said planar substrate, filling said cavities with a magnetic material to form said two strips having vertical faces, said filling step including providing a conductive material on the vertical faces of said two strips, isotropically etching, in said planar substrate, a well that extends between said vertical faces of said two strips and beneath and around a distal end of at least one of said two strips to open an air gap between said two strips, whereby said distal end is made capable of being shifted between a closed position, in which said vertical faces of said two strips are in direct mechanical contact with each other to enable the passage of a current, and an open position, in which said vertical faces of said two strips are separated from each other by said air gap to electrically insulate one strip from the other, wherein providing the conductive material on at least the vertical faces of said two strips comprises, before filling said cavities with said magnetic material, causing deposition of a coating of said conductive material at least on said vertical flanks, with a thickness being smaller than half of a thickness of said strips.

* * * * *